US005334073A

United States Patent [19]

Tilbor et al.

[11] Patent Number: 5,334,073

[45] Date of Patent: Aug. 2, 1994

[54] CRASH DUMMY FIGURES

[75] Inventors: Neil Tilbor, Medford; Anthony R. Garr, Voorhees; Jean Newton, Marlton, all of N.J.; Salvatore Mucaro, Burlington, Conn.

[73] Assignee: Tyco Investment Corporation, Wilmington, Del.

[21] Appl. No.: 109,868

[22] Filed: Aug. 20, 1993

Related U.S. Application Data

[63] Continuation of Ser. No. 832,563, Feb. 7, 1992, abandoned.

[51] Int. Cl.[5] ..... A63H 3/00; A63H 3/16; A63H 3/46

[52] U.S. Cl. ..... 446/308; 446/4; 446/382; 273/380

[58] Field of Search ..... 446/308, 309, 330, 4, 446/6, 376, 390, 382; 273/379, 380, 383, 384, 393; 434/305, 274, 267

[56] References Cited

U.S. PATENT DOCUMENTS

| | | | |
|---|---|---|---|
| 1,277,702 | 9/1918 | Des Combes | 273/380 |
| 2,037,052 | 4/1936 | Wittmann . | |
| 2,968,122 | 1/1961 | Wescott . | |
| 3,010,223 | 11/1961 | Alderson . | |
| 3,277,602 | 10/1966 | Speers et al. . | |
| 3,425,153 | 2/1969 | Bonanno et al. . | |
| 3,716,942 | 2/1973 | Garcia et al. . | |
| 3,724,125 | 4/1973 | Goldfarb et al. . | |
| 3,859,752 | 1/1975 | Morrison et al. | 446/6 |
| 4,118,888 | 10/1978 | Ogawa . | |
| 4,120,117 | 10/1978 | Terzian et al. . | |
| 4,125,961 | 11/1978 | Yamashina . | |
| 4,565,537 | 1/1986 | Klimpert et al. | 446/321 |
| 4,579,476 | 4/1986 | Post | 403/322 |
| 4,623,318 | 11/1986 | Tsiknopoulos et al. | 446/330 |
| 4,673,367 | 6/1987 | MacBain | 446/4 |
| 4,696,656 | 9/1987 | Torres et al. | 446/376 |
| 4,988,323 | 1/1991 | Price | 446/334 |
| 5,100,327 | 3/1992 | Gladish | 434/305 |

FOREIGN PATENT DOCUMENTS

| | | |
|---|---|---|
| 624287 | 7/1927 | France . |
| 1437654 | 6/1976 | United Kingdom . |

OTHER PUBLICATIONS

"Educational Products Catalog", Health Edco, Waco, Texas, Dec. 1989, Front Cover, Rear Cover & p. 43 (Dec. 1989).

"Crash Kramer Instructions", Health Edco, Dec. 1989, 2 pages.

Larry Deutchman, Division Director, Committee For Safety Belt Awareness, Letter to NHTSA (National Highway Traffic Safety Administration), Aug. 1988, 3 pages.

"Instructions/Anleitungen/Istruzioni" Mattel, Inc., 1986, 2 pages.

(List continued on next page.)

*Primary Examiner*—Mickey Yu

*Attorney, Agent, or Firm*—Panitch Schwarze Jacobs & Nadel

[57] ABSTRACT

A toy figure has a torso with a plurality of removable, spring-biased appendages. Each appendage inserted into the torso with connectors. Each of the connectors includes a groove for receiving a movable detent to attach the appendages to the torso. The front of the toy figure contains two buttons which are actuated upon application of a force. When an upper button is actuated, three spring detents move out of engagement with the connector grooves causing both arms and the head appendages to be simultaneously released and biased outwardly from the torso. When a lower button is actuated, two spring detents move out of engagement with connector grooves, causing both leg appendages to be simultaneously released and biased outwardly from the torso.

18 Claims, 5 Drawing Sheets

OTHER PUBLICATIONS

Ross, Sylvia P., "10 Traffic Safety Guides/for Teachers Grades K-3/1979-1980", American Automobile Association, 1979, front and rear outer covers, inner cover and pp. 1-20.

"Preschool Safety Belt Program/Ready Click Go", Iowa Dept. of Transportation, Dec. 1989, Cover and pp. 1-12.

Photographs of Iowa Dept of Transportation Toy 3-Dimensional Land Vehicle with 3-Dimensional Human shape Passenger Figures and Velcro® Seat Belts and Ramp, Iowa Dept. of Transportation, Dec. 1989, 5 pages, 17 photographs.

Jolly K. "Children & Traffic/1 On the pavement/A book for teachers", 1977, Cover, copyright page and p. 31.

J. Finigan, "Woodland 'Turtles' Honored", *Northwest Arkansas Times,* May 26, 1990, p. 6A.

"Safety Turtles Honored by National Coalition", Springdale News, Apr. 29, 1990.

CRASH DUMMY FIGURES

This is a continuation of application Ser. No. 07/832,563, filed Feb. 7, 1992, abandoned.

FIELD OF THE INVENTION

The present invention relates to a toy figure and, more particularly, a figure simulating a crash dummy where the appendages of the dummy are removable.

BACKGROUND OF THE INVENTION

In the toy field, there exists a need for toy figures having unique and novel features which appeal to children. Further, toys having a dual purpose, e.g., amusement and education, are popular with both children and adults. Moreover, the toy figure must be easily assembled and have a relatively inexpensive manufacturing cost.

Various toy figures having movable or detachable appendages have been disclosed in the prior art. For example, U.S. Pat. No. 4,118,888 discloses an articulated magnetic doll with removable appendages. The appendages are attached to joined portions on first and second armature plates which are held by a magnet. Contained within the doll is a spring-loaded firing mechanism actuated by a lever, which causes the forward discharge (under the urging of a spring) of the first or lower portion of the arm appendage as a projectile. The appendage or projectile is held in the arm by a disc which is engaged by a latch.

U.S. Pat. No. 4,125,961 discloses a doll with movable arms, legs and head in which a coil spring within an arm is initially compressed by the arm end portion and then placed in tension by a lever. The actuation of the lever causes the ejection of certain movable parts on the toy doll. When ejected, movable parts on the toy (the lower arm portion) are projected forward by the force of the coil spring.

U.S. Pat. No. 3,724,125 discloses a doll with a push-button actuator. The limbs of the doll are attached to a torso comprised of front and back halves where the actuation of the push button causes the limbs which are attached to the torso with strings to relax or to move. Whether the limbs relax or move upon actuation of the push button depends upon the previous position of the limbs.

U.S. Pat. No. 3,277,602 discloses a toy figure or doll having movable joints. The joints on the doll contain both a pin and a radial slot. The lower portion of a leg, for example, is pivotable around the pin in the joint and rotatable around a radial slot in order to simulate the movement of human limbs.

U.S. Pat. No. 3,425,153 is a toy doll where a limb of the doll is actuatable and removable. When pressure is applied to a designated portion on the exterior of the doll, one of the arms of the doll is rotated forward. The arm that is rotatable may also be removed from the doll upon removing the screw which attaches the arm to the torso of the doll.

SUMMARY OF THE INVENTION

Briefly stated, the present invention comprises a toy figure having a torso with a plurality of openings at appendage locations and a plurality of individual appendages. Each appendage has a connector at one end received in at least one of the torso openings. The toy figure further comprises a detent member within the torso associated with each opening receiving and retaining in the torso the connector which is received in the opening. Biasing means for biasing each connector received in any of the torso openings out of the receiving opening are also present. An actuator is present in the torso and is coupled with at least two of the detent members so as to simultaneously move at least two of the detent members and release any connectors being detained by any of the detent members.

BRIEF DESCRIPTION OF THE DRAWINGS

The foregoing summary, as well as the following detailed description is better understood when read in conjunction with the appended drawings. For the purpose of illustrating the invention, an embodiment which is presently preferred is shown in the drawings. It is understood, however, that this invention is not limited to the precise arrangements and instrumentality shown. In the drawings.

DESCRIPTION OF THE PREFERRED EMBODIMENT

Figure 1:
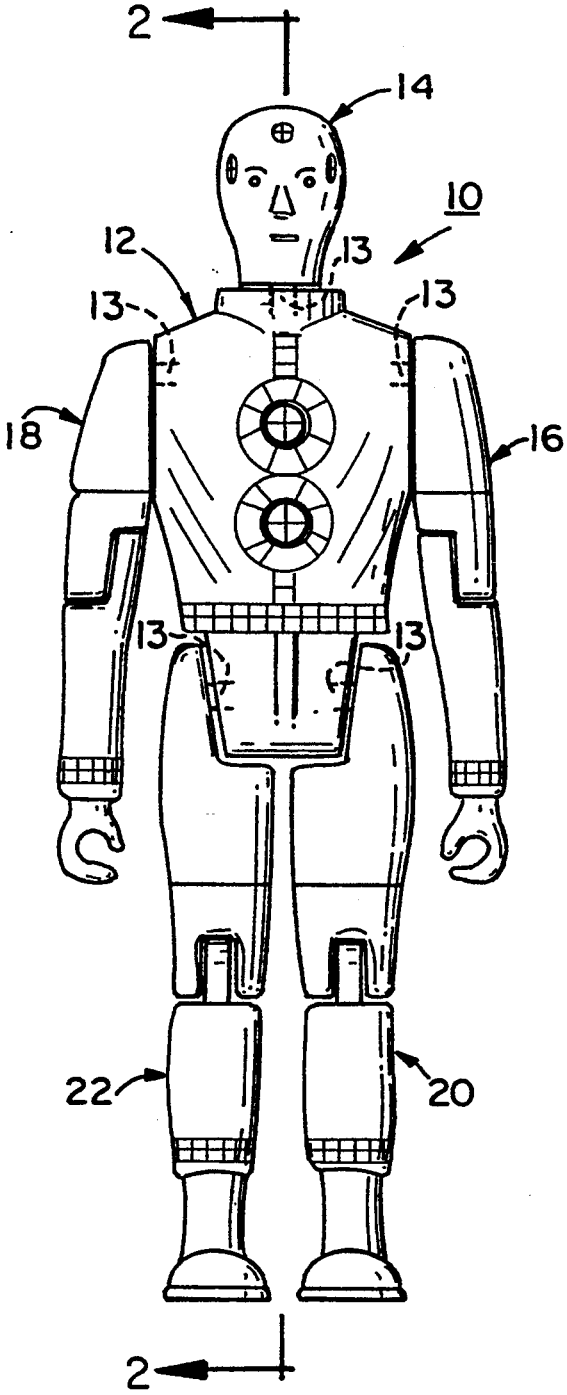
FIG. 1 is a front elevational view of a toy figure in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the toy figure and designated parts thereof. The terminology includes the words specifically mentioned above, their derivatives and words of similar meaning.

Referring to the drawings in detail, wherein like numerals indicate like elements throughout, there is shown in FIG. 1 a view of a preferred embodiment of a toy figure in accordance with the present invention, which is generally designated as element numeral 10. FIGS. 2–11 show various views of the components of the toy FIG. 10.

Figure 10:
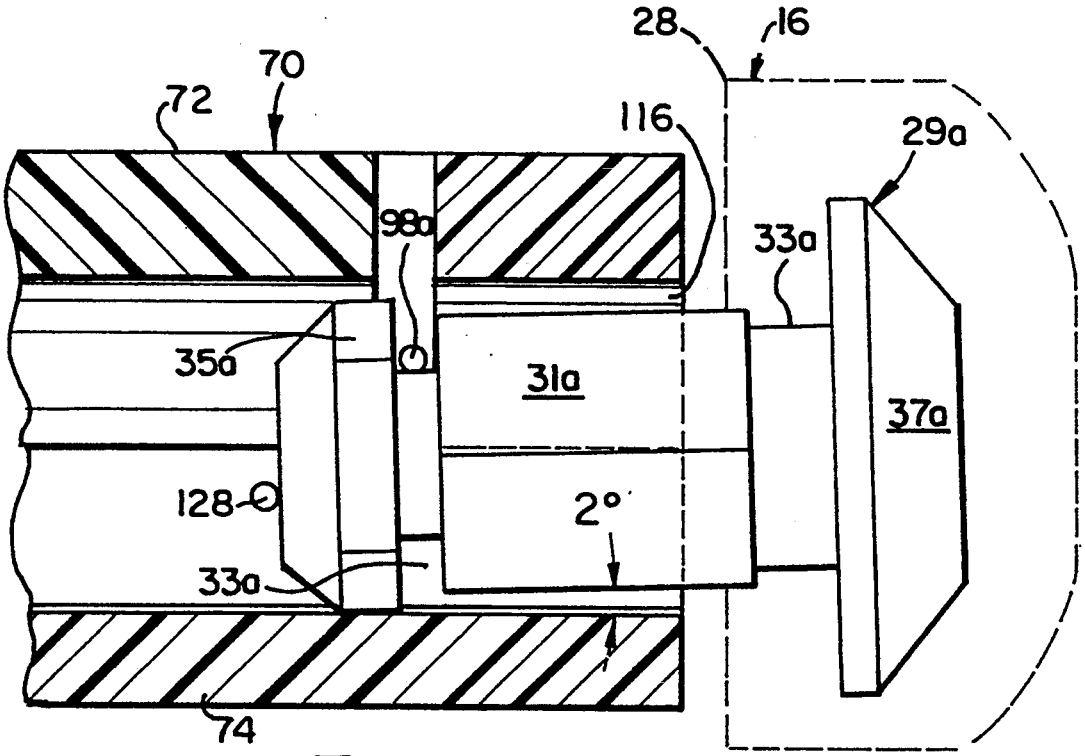
FIG. 10 is a elevational, cross-sectional view of an arm appendage connector and of the shoulder appendage opening in the torso of the toy figure.

Referring now to FIG. 1, the preferred toy FIG. 10 of the present invention is human-like in appearance and includes a torso 12 having five appendage openings 13 which are seen in various figures and are located at the neck, either opposing shoulder region and either opposing hip region of the torso 12, through which are connected the following appendages: a head 14, a left arm 16, a right arm 18, a left leg 20 and a right leg 22.

The left arm 16 includes a forearm 24, an elbow 26 and an upper arm 28. The forearm 24 is hingeably connected to the elbow 26 through a transverse hinge pin 30. The elbow 26 is rotatably connected to the upper arm 28 by a pin-type axial connector 31. Right arm 18 mirrors the left arm 16. Each of the upper arms 28 is connected to the torso 12 by a pin-type connector **29*a* only a portion of which can be seen in FIG. 1** and which will be described in more detail below.

The left leg 20 of the toy FIG. 10 includes a lower leg 32, a knee 34 and an upper leg 36. The lower leg 32 is hingeably connected to the knee 34 through a transverse hinge pin 38. The knee 34 is rotatably connected to the upper leg 36 by a pin-type axial connector 39. The upper leg 36 is connected to the torso 12 of the toy FIG. 10 by a pin-type connector **29*b*, again only partially seen in FIG. 1. Right leg 22 mirrors left leg 20. Head 14 includes a connector 29*c*. The toy FIG. 10 further includes an upper actuator button 40 and a lower actuator button 42 located along the front vertical midline of the torso 12**.

It is preferred that the elements and their components of the toy FIG. 10, with the exception of any hinge pins or spring wires (which are preferably constructed of a metallic material, such as spring steel) be constructed of a polymeric material. Specifically, it is preferred that the polymeric materials be polyvinyl chloride (PVC), acrylonitrile-butadiene-styrene (ABS) resin, high-impact polystyrene (HIPS) and/or acetal resin. These polymeric materials provided the toy FIG. 10 with a tough, rigid thermoplastic exterior and rigid, durable and lightweight components. However, it is understood by those skilled in the art that the above-mentioned elements and components could be constructed of other polymeric materials or materials having like qualities, such as, for example, polycarbonate, without departing from the spirit and scope of the invention.

Preferably, the above-mentioned elements and components of polymeric material of the toy FIG. 10 are formed by standard molding processes as understood by those skilled in the art. However, it is also understood by those skilled in the art that other materials and processes could be used to construct the elements of the toy FIG. 10, such as machining.

Figure 2:
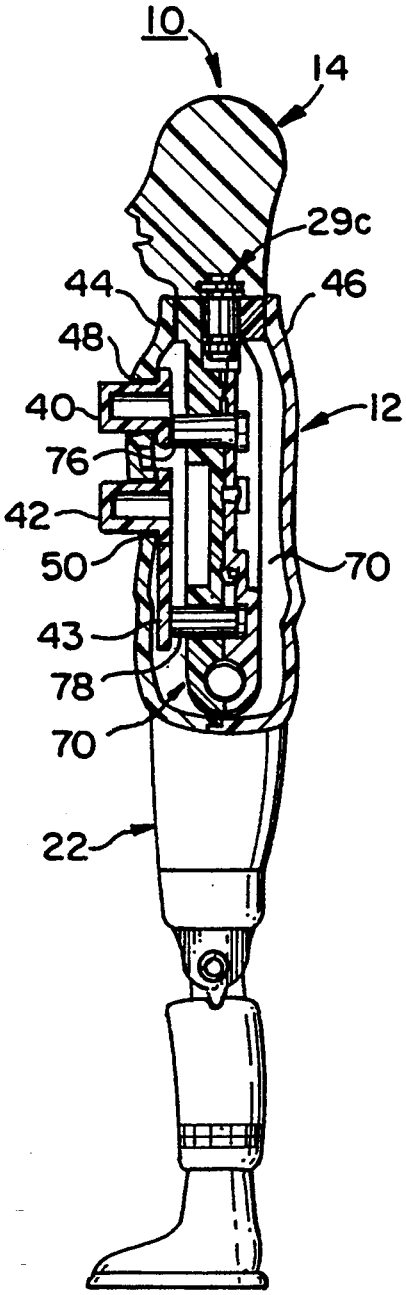
FIG. 2 is a cross-sectional view of the toy figure taken along line 2—2 of FIG. 1.
Figure 3:
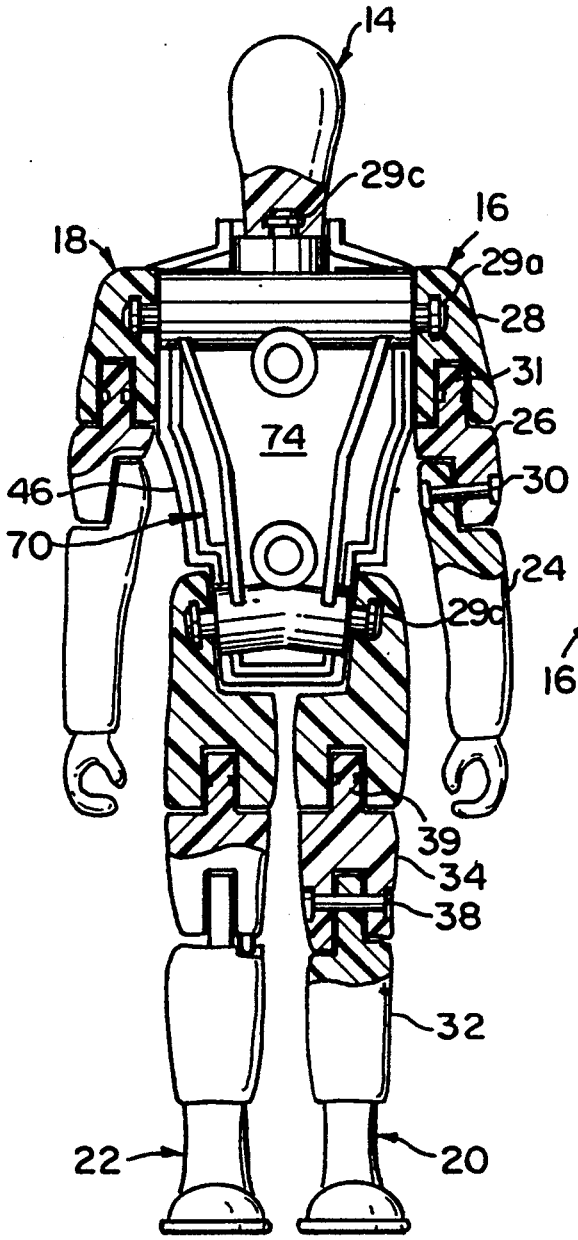
FIG. 3 is a partially broken away front elevational view of the toy figure.
Figure 4:
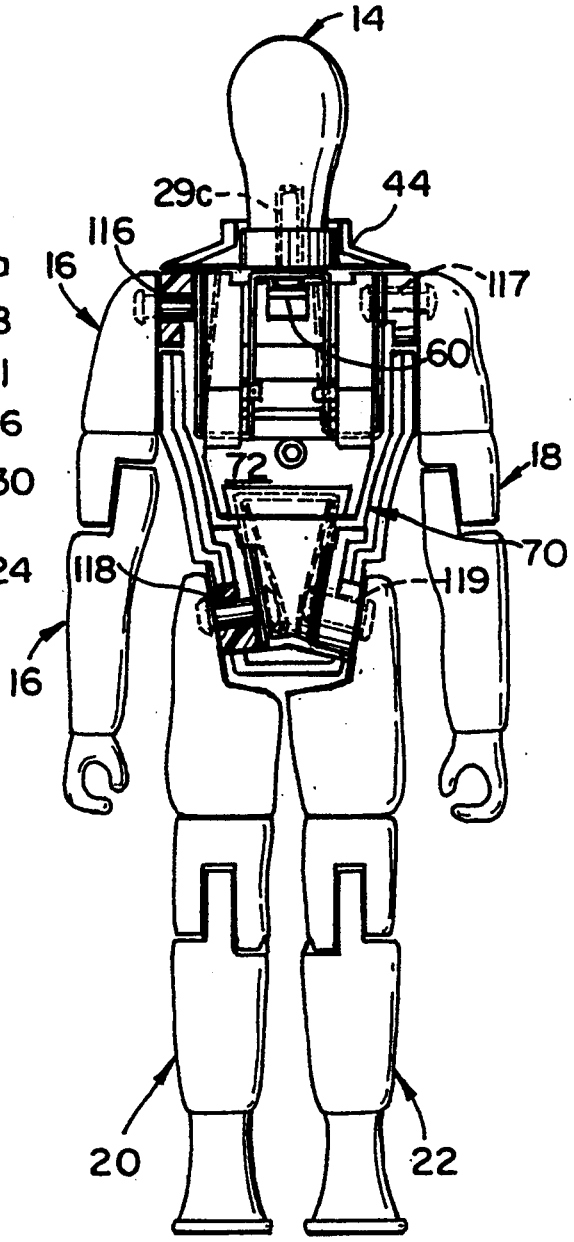
FIG. 4 is a rear elevational view of the toy figure with a rear torso cover removed.

Referring now to FIGS. 2–4, in a preferred embodiment of the present invention, the torso 12 of the toy FIG. 10 includes a front shell 44 having an upper circular opening 48 and a lower circular opening 50 located along the vertical midline of the front shell through which outwardly extend the upper actuator button 40 and the lower actuator button 42. The torso further includes a back torso shell 46. The front torso shell 44 and the back torso shell 46 each include semicircular peripheral edge openings located in the hip, shoulder and neck area of both of the torso shells. When the torso shells 44, 46 are mated together, the semicircular openings on each of the torso shells align to form, in part, the five openings which include two mirror-image circular shoulder openings, two mirror-image circular hip openings and a single circular neck opening.

Figure 11:
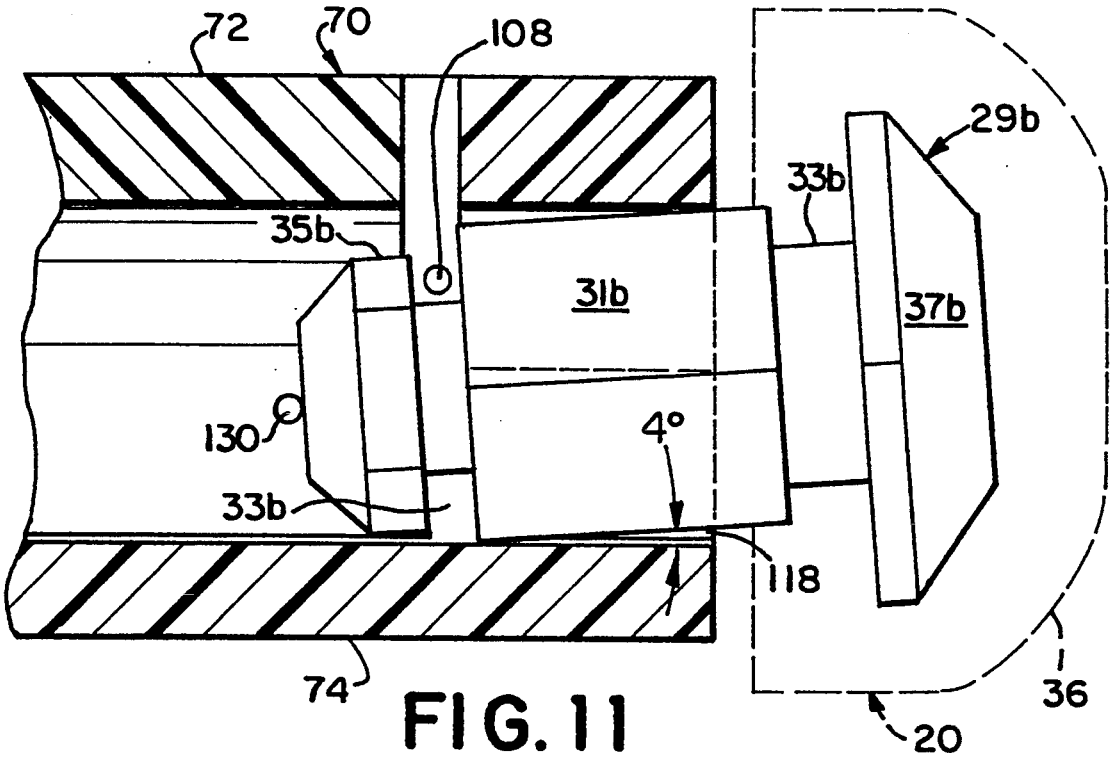
FIG. 11 is an elevational, cross-sectional view of a leg appendage connector and of the hip appendage opening in the torso of the toy figure.

Referring now to FIG. 10, the arm connector **29*a* preferably is generally hexagonally cylindrical in shape and includes a hexagonal head 37*a* which is attached to the upper arm 16, for example by embedment, such that the remainder of the connector extends outwardly from the appendage. The connector 29*a* preferably further includes a hexagonal shank 31*a*, a groove 33*a* circumscribing the connector and a beveled hexagonal tip 35*a*, the vertices of the tip being about thirty degrees out of phase with the vertices of the shank 31. Preferably tip 35*a* has a greater maximum outer diameter than that of shank 31*a*. FIG. 11 shows the connector 29*b* used for the legs 20, 22 which preferably includes hexagonal shank 31*b*, circumferential groove 33*b* and beveled hexagonal tip 35*b*. Preferably, the hexagonal shank 31*b* has a maximum outside diameter greater than that of the beveled tip 35*b*. A circularly cylindrical connector 29*c* seen in FIGS. 2–4 is used for the head and includes a cylindrical shank with annular groove 33*c*** and beveled tip.

Referring to FIGS. 2–9, an appendage holding/ejectment mechanism 70 is located inside the torso 12, which is itself preferably formed by the torso front shell 44 and the torso back shell 46. The mechanism 70 includes a spring housing 72 and a cover 74. Preferably, the spring housing 72 and the cover 74 are constructed of ABS and are connected together through one or more ultrasonic weld beads (not shown). Further included within the mechanism 70 are an arm and head release button 76, a leg release button 78, two arm and leg load springs 80, a head load spring 82, an arm and head hold spring 84 and a leg hold spring 86.

Figure 8:
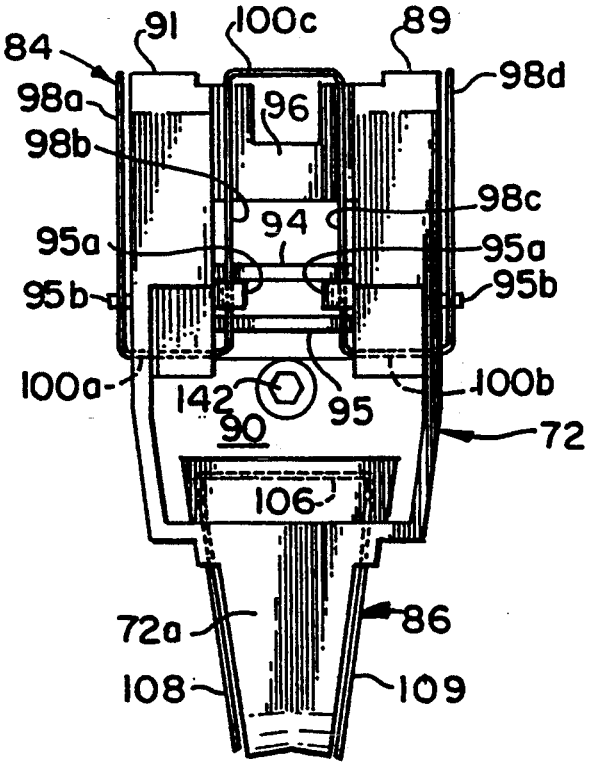
FIG. 8 is a rear elevational view of the second component of the ejectment mechanism.
Figure 7:
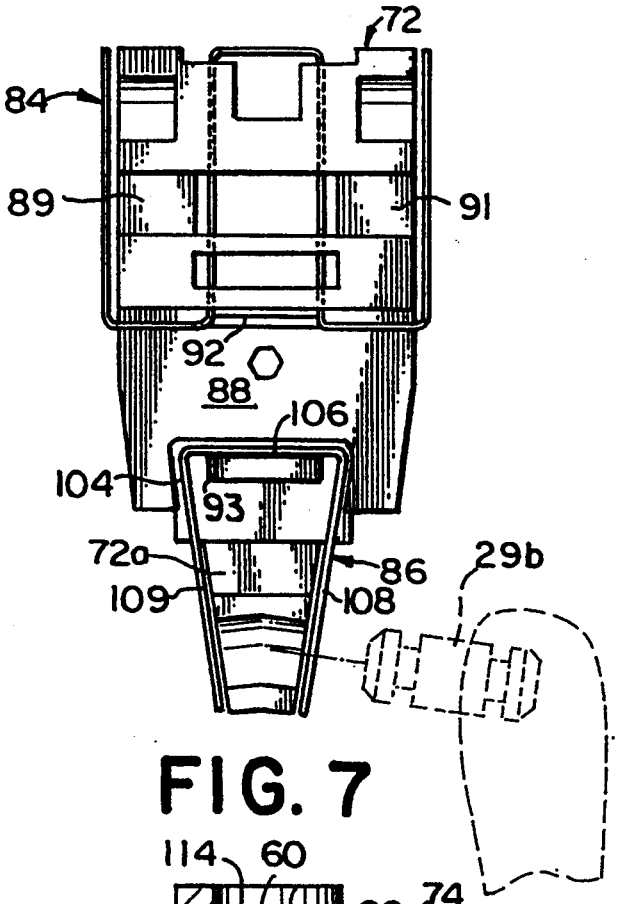
FIG. 7 is a front elevational view of a second component of the ejectment mechanism.

The spring housing 72 includes a front (inner) face 88, a rear (outer) face 90, seen in FIGS. 7 and 8, respectively, with integrally molded lateral upright members 89 and 91. Located on the front face 88 is an upper groove 92 horizontally traversing the housing 72 at the base of the lateral upright members 89 and 91. Holding tab 93 is located below a lower horizontal groove 104 on the inner front face. Two lower cross ribs 94, 95 and an upper cross rib 96 extend between the upright members 89, 91. Located on the outer rear face 90 of spring housing 72 are inner, facing support tabs **95*a* and outer, opposing support tabs 95*b***.

Preferably, arm and head hold spring 84 is a one-piece torsional spring, made from music wire. The arm and head hold spring 84 preferably includes four parallel, upwardly extending portions of substantially equal length located at an outer left **98*a*, left center 98*b*, right center 98*c* and outer right 98*d* regions of the spring 84. Connecting the lower extremity of the outer left 98*a* and left center 98*b* portions is a left horizontal portion 100*a*. Attached to the lower extremity of the right center 98*c* and outer right 98*d* portions is a right horizontal portion 100*b*. Attached to an upper extremity of the right center 98*c* and left center 98*b* portions is a center horizontal portion 100*c*. Preferably, all of the horizontal portions are of equal length. The center portions 98*c* and 98*b* are bent forwardly at a ninety degree angle and again laterally towards one another adjacent to their connection with the center horizontal portion 100*c*. The horizontal portions 100*a*, 100*b* of the arm and head hold spring 84 are located within the upper groove 92 of the spring housing 72. The center portions 98*b* and 98*c* are located between the lower and upper cross ribs 94, 96 and the inner support tabs 95*a*. The upwardly extending outer portions 98*a*, 98*d* of the arm and head hold spring 84 rest in front of the outer support tabs 95*b***.

The leg hold spring 86 is preferably a one-piece torsional spring made of music wire. The leg hold spring 86 is preferably generally U-shaped having a horizontal portion 106 connected between two inwardly biased, downwardly extending members 108, 109. The horizontal portion 106 of the leg hold spring 86 is located within the lower groove 104 of the spring housing 72 and rests on the holding tab 93. Legs 108, 109 generally parallel tapering sides of a lowermost portion 72*a* of housing 72.

Figure 5:
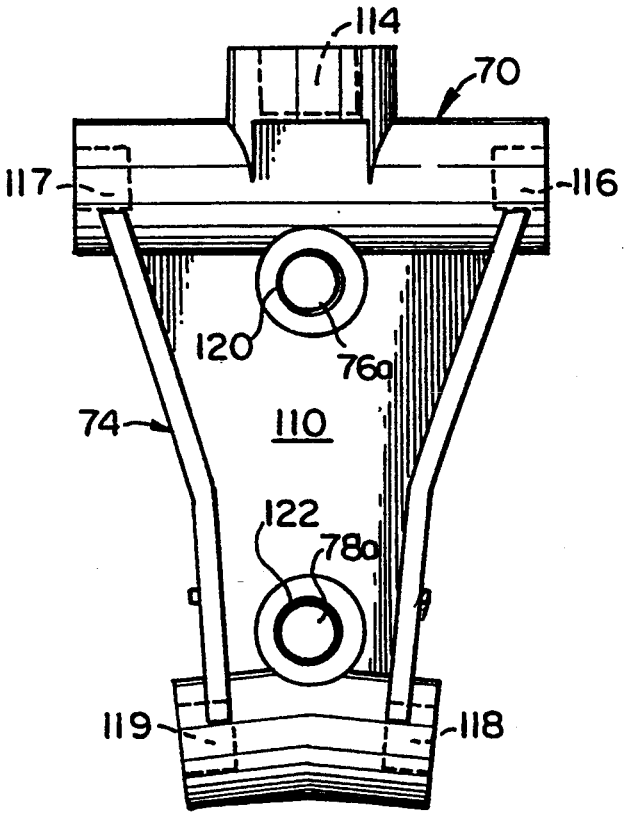
FIG. 5 is a front elevational view of a first component of the ejectment mechanism.
Figure 9:
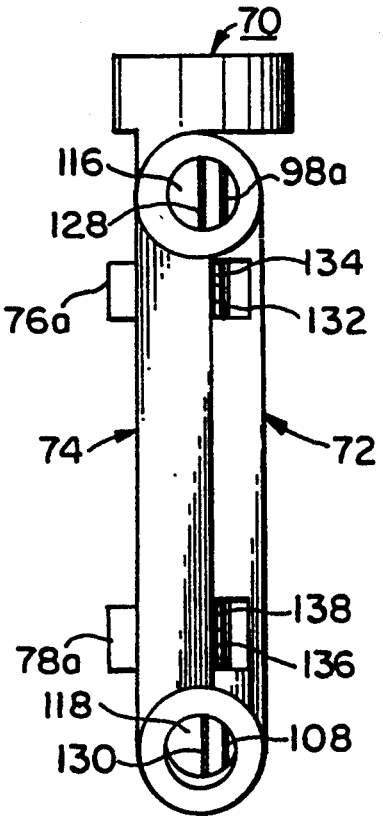
FIG. 9 is a side elevational view of the ejectment mechanism.
Figure 6:
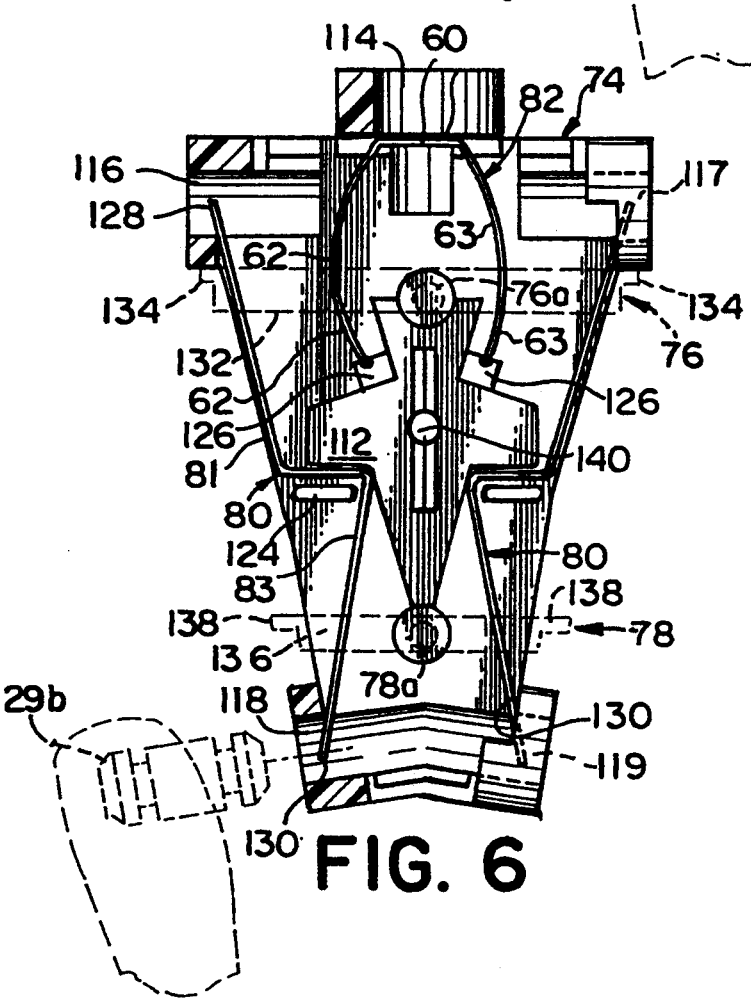
FIG. 6 is a rear elevational view of the first component of the ejectment mechanism.

The cover 74 of the mechanism 70 includes an outer, front face 110 and an inner, rear face 112, best seen in FIGS. 5 and 6, respectively. Cover 74 further includes an upper circular aperture 120, a lower circular aperture 122, a head opening 114, left and right arm openings 116, 117 and left and right leg openings 118, 119. The head opening 114 is circular in shape. The arm openings 116, 117 and leg openings 118, 119 are of a composite shape where the back, inner half of each opening is semicircular, while the front, inner half remainder of the opening is partially hexagonal, preferably having three planar faces. The cover 74 further includes on the inner rear face 112 a pair of spring hold tabs 124 and a pair of spring hold apertures 126 extending through the cover.

Preferably, the arm and leg load springs 80 and the head load spring 82 are torsional springs, each made from music wire, all of their portions being contiguous. The head load spring 82 is generally inverted U-shaped having a central, generally horizontal portion 60 connected between two downwardly extending portions 62, 63, each of which is bent outwardly at a ninety degree angle adjacent to its extremity. The extremities are located in the spring hold apertures 126 of the cover 74 while the horizontal member 60 of the head load spring 82 is located directly below the head opening 114 of the cover to provide a biasing means for biasing a connector 29 out of the head opening 114.

Each of the two, identical arm and leg load springs 80 includes an upwardly extending portion 81 and a downwardly extending portion 83 joined by a horizontal portion 85. The horizontal portions 85 of the springs 80 are held in place on the left and right sides of the cover 74 by the spring hold tabs 124 and opposing bosses in the cover. The upper extremity 128 and the lower extremity 130 of each of the load springs 80 extend into a central area of the arm openings 116 or 117 and the leg openings 118 or 119 of the cover 74, respectively, providing a biasing means for biasing a connector 29 out of the openings.

The arm and head release member 76 is indicated in FIG. 6 in phantom. It includes a cross member 132 having a central raised circular cylinder-like button 76*a*, which extends through the cover 74 and projects outwardly from the vertical midline of the front face 110 of the cover 74 through opening 120. The cross member 132 includes tabs 134 at its opposing lateral ends. The leg release member 78 includes a cross member 136 having a central section from which a raised circular cylinder-like button 78*a* extends through the cover 74 and projects outwardly from the vertical midline of the front face 110 of the cover through opening 122. The cross member 136 includes tabs 138 at its opposing lateral ends.

The cover 74 preferably further includes a post 140 extending from the rear face 112 while the spring housing 72 includes a sleeve 142 in inner front face 90 sized complementary to the post 140 to mate with post 140. When the mechanism 70 components are assembled, the rear face 112 of the cover 74 is in facing opposition to the front face 88 of the spring housing 72. The post 140 of the cover 74 is mated with the sleeve 142 of the spring housing 72 providing the mechanism 70 with two faces, a front one being the cover front face 110, a rear one being the spring housing rear face 90. Disposed between the spring housing 72 and the cover 74 are the two, mirror arm and leg load springs 80, the head load spring 82, the arm and head hold spring 84, the leg hold spring 86 and the cross members 132, 136.

The arm and head release cross member 132 is located in front of and in engagement with the upwardly extending portions 98*a*, 98*b*, 98*c* and 98*d* of the arm and head hold spring 84. The cross member tabs 134 engage the outer portions 98*a* and 98*d* of the arm and head hold spring 84 while the body of member 132 engages center portions 98*b* and 98*c*. The extremities of the outer 98*a* and portions 98*d* of the arm and head hold spring 84 extend into and through the arm openings 116, 117 to provide arm detents. The center horizontal portion 100*c* is located below the head opening 114 to provide a head detent.

The tabs 138 of leg release button cross member 136 are located in front of and in engagement with the downwardly extending portions 108, 109 of the leg holding spring 86. The extremities of the downwardly extending portions 108 extend into and through the leg openings 118, 119 to provide leg detents.

Located between the arm and head release button cross member 132 and the cover rear face 112 are the upwardly extending portions 81 of the arm and leg load springs 80. Located between the leg release button cross member 136 and the cover rear face 112 are the downwardly extending portions 83 of the arm and leg load springs 80.

Referring to FIG. 2, the upper actuator button 40 has a rear face which is in engagement with the arm and head release member button 76*a*. The lower actuator button 42 further includes a tongue 43 extending downwardly between shell 44 and mechanism 70 having a rear surface 45 which is in facing engagement with the leg release member button 78*a*.

In use, the arm 16, 18, leg 20, 22 and head 14 appendages are connected to the torso assembly 12. The connector 29*a, b* or *c* located on each of the appendages is inserted into the appropriate appendage opening in the torso 12 and then into the respective head opening 114, arm openings 116, 117 or leg openings 118, 119 of the mechanism 70.

The beveled tip 35 of each connector 29*a* and *c* of the arms 16, 18 and the head 14, respectively, rearwardly biases by a camming action the detents located within the arm openings 116, 117 and head opening 114 and formed by spring portions 98*a*, 98*d* and 100*c*, respectively. Additionally, the beveled tip 35 of each of said connectors inwardly biases the extremities 128 of the upwardly extending members 81 of the arm and leg load springs 80. The connector 29*c* of the head 14 downwardly biases the horizontal member 60 of the head load spring 82.

As the beveled tip 35 of the connector 29*a* or *c* is further inserted into the arm or head openings 116, 117 or 114, respectively, the camming action is completed and the arm or head detents are then forwardly biased by the torsion of the arm and head hold spring 84 and engage the groove 33*a* or *c* of the respective connector 29*a* and *c*, securely attaching the arm(s) 16, 18 and/or head to the torso 12.

The beveled tip 35*b* of each connector 29*b* of the legs 20, 22 rearwardly biases by a camming action the leg detents located within the leg openings 118, 119 and provided by spring portions 108, 109. Additionally, the beveled tip 35 of said connector **29*b* inwardly biases the extremities 130 of the downwardly extending members 83 of the arm and leg load springs 80**.

As the beveled tip **35*b* of the connector 29*b* is further inserted into the leg openings 118, 119 the camming action is completed and the leg detents formed by spring portions 108, 109 are then forwardly biased by the torsion of the leg hold spring 86 and engage the groove 33*b* of the connector 29*b*, securely attaching each of the legs 20, 22 to the torso 12**.

Attachment of the arm 16, 18 and leg 20, 22 appendages to the torso 12 results in a loose facing engagement of the hexagonal shank **31*a* or 31*b* of the connector 29*a* or 29*b* with the partially hexagonal surface of the arm openings 116, 117 or leg openings 118, 119 respectively. This configuration allows a user of the toy FIG. 10 to fixedly position these limbs at various angles with respect to the torso 12**. This assists greatly in being able to pose the figures in an upright pose and having the figure maintain the pose.

When a user of the toy FIG. 10 desires to eject the appendages, a force is applied to one or both of the upper actuator button 40 and the lower actuator button 42. If the force is applied to the upper actuator button 40, the rear face of the button 40 engages the cylinder **76*a* of the arm and head release member 76 rearwardly moving the cross member 132. Rearward motion of the cross member 132 rearwardly biases the outer 98*a*, 98*d* and center 98*b*, 98*c* upwardly extending portions of the arm and head hold spring 84 such that the arm detents and head detent defined by the ends and central horizontal portion of that spring disengage from the groove 33*a* and *c* of the connector 29*a* and *c* of each of the arms 16, 18 and the head 14. An outward biasing of the upper extremity 128 of each of the two arm and leg load springs 80 occurs against the beveled tip 35*a* of each of the arm connectors 29*a* resulting in an outward ejectment of the arms 16, 18. Concomitantly, an upward biasing of the horizontal member 60 of the head load spring 82 occurs against the beveled tip 35*b* of the head connector 29*c* resulting in an upward ejectment of the head 14**.

When the user applies a force to the lower actuator button 42, the rear surface of the tongue 43 engages the cylinder **78*a* of the leg release member 78 causing a rearward motion of the cross member 136. Such motion of the cross member 136 rearwardly biases the downwardly extending portions 108, 109 of the leg hold spring 86 such that the leg detents formed by the extremities of those portions disengage from the groove 33*b* of the connector 29*b* of each of the legs 20, 22. An outward biasing of the lower extremity 130 of each arm and leg load spring 80 occurs against the beveled tip 35*b* of each connector 29*b* resulting in an outward ejectment of each of the legs 20, 22**.

It is appreciated by the ordinarily skilled artisan that the presently claimed invention may include other components which are equivalent to those discussed specifically above. For example, the present invention includes biasing means for the detainment of and ejection of the appendages. If desired, biasing equivalents such as other types of springs or spring linkages, compressible foams or other elastomeric materials can be used. Detents can be formed with means other than springs, such as movable rigid members operated by appropriate lever(s) and/or linkage(s). Also, one of ordinary skill will be able to modify the preferred designs to release, for example, one arm and one leg by one button and the remaining arm and leg by a remaining button. The head might be released by only one of the two buttons, either button, or not released at all. Further, different connector configurations and limb/torso configurations, for example animal-like configurations, may be employed in the present invention.

From the foregoing description, it can be seen that the present invention comprises a toy FIG. 10 having movable, poseable and multi-ejectable appendages. It is recognized by those skilled in the art that changes may be made to the above-described embodiment of the invention without departing from the broad inventive concept thereof. It is understood, therefore, that this invention is not limited to the particular embodiment disclosed, but is intended to cover all modifications which are within the spirit and scope of the invention as defined by the appended claims.

We claim:

1. A toy figure comprising:

a torso having a plurality of openings at appendage locations;

a plurality of individual appendages comprising arm appendages and leg appendages, each appendage including a connector at one end received in at least one of the openings;

a detent within the torso associated with each opening receiving and retaining in the torso a connector received in the opening wherein the detents receiving and retaining each of a first pair of the appendages are collectively formed from a first single wire torsion spring;

biasing members located on the torso so as to bias each connector received in any of the openings out of the receiving openings; and an actuator in the torso coupled with at least two of the detents so as to simultaneously move the at least two detents and release any connectors being detained by any of the at least two detents.

2. The toy figure of claim 1 wherein a portion of the actuator is exposed on the torso for manual actuation of the coupled detents.

3. The toy figure of claim 1 wherein the actuator is coupled with the detents associated with openings at leg locations in opposing hip regions of the torso.

4. The toy figure of claim 1 wherein the actuator is coupled with detents associated with openings at arm locations in opposing shoulder areas of the torso and an opening at a head location in a neck area of the torso.

5. The toy figure of claim 4 further comprising a second actuator coupled with detents associated with openings at leg locations in opposing hip regions of the torso so as to move the coupled detents simultaneously and release any connectors being detained in the leg location openings.

6. The toy figure of claim 1 further comprising a second actuator on the torso coupled with at least two remaining detents so as to move the at least two remaining detents and release any connectors being detained by any of the at least two remaining detents.

7. The toy figure of claim 6 wherein portions of the first and second actuators are exposed through the torso adjacent to one another for simultaneous manipulation and release of all limbs detained in all torso openings.

8. A toy figure of claim 1 wherein the detents receiving and retaining connectors in each of two arm appendage openings are collectively formed from the first single wire torsion spring and wherein the detents receiving and retaining connectors in each of the leg appendage openings are collectively formed from a second single wire torsion spring.

9. A toy figure comprising:

a torso having a plurality of openings at appendage locations;

a plurality of individual appendages, each appendage including a connector at one end received in at least one of the openings;

a detent within the torso associated with each opening receiving and retaining in the torso a connector received in the opening;

biasing members mounted on the torso so as to bias each connector received in any of the openings out of the receiving openings wherein the biasing means is retained within the torso when the appendages are released; and an actuator in the torso coupled with at least two of the detents so as to simultaneously move the at least two detents and release any connectors being detained by any of the at least two detents.

10. A toy figure comprising:

a torso having a plurality of openings at appendage locations;

a plurality of individual appendages, each appendage including a connector at one end received in at least one of the openings;

a detent within the torso associated with each opening receiving and retaining in the torso a connector received in the opening;

biasing members mounted on the torso so as to bias each connector received in any of the openings out of the receiving openings, the biasing members comprising a first single wire torsion spring mounted to simultaneously bias any connectors received in at least arm and leg appendage openings on one side of the torso out of said openings; and an actuator in the torso coupled with at least two of the detents so as to simultaneously move the at least two detents and release any connectors being detained by any of the at least two detents.

11. A toy figure of claim 10 wherein the first torsion spring is retained in the torso after the release of any of the arm and leg appendages on the one side of the torso.

12. A toy figure of claim 11 wherein each of the detents receiving and retaining each of the arm and leg appendages on the one side of the figure is formed by a wire torsion spring.

13. A toy figure of claim 12 wherein the stated actuator is a first actuator coupled with detents associated with the head and arm appendages and further comprising a second actuator on the torso coupled with detents associated with the leg appendages, the first and second actuators being exposed on the torso adjacent to one another for simultaneous manipulation and release of all the individual appendages.

14. A toy figure of claim 13 wherein one of the first and second actuators include a button portion exposed through the torso and a tongue extending transversely from the button portion and the remaining actuator longitudinally through the torso towards the appendages controlled by the one actuator, the tongue being coupled with the first torsion detent spring so as to release the appendage detained along the one side of the torso by the first torsion detent spring by depression of the button portion of the one actuator into the torso.

15. A toy figure of claim 14 wherein the torso comprises an inner mechanism defining the arm, head and leg appendage openings and fixedly retaining each detent torsion wire spring and each biasing means torsion wire spring; and at least one outer shell separate from the mechanism through which the pair of actuators are exposed, the outer shell being shaped to define an outer surface of the toy figure.

16. A toy figure of claim 15 wherein at least one of the actuators is supported between the frame and the outer shell of the torso by the outer shell.

17. A toy figure of claim 12 wherein at least one of the arm and leg appendages includes a connector received in a respective appendage opening in the torso, the connector being provided with a plurality of planar surfaces around its circumference and the appendage opening of the torso receiving the connector further having at least one planar surface mating with one of the connector planar surfaces when the connector is biased against the opening planar surface by the detent torsion wire spring.

18. A toy figure comprising:

a torso having a plurality of openings at appendage locations;

a plurality of individual appendages comprising arm appendages and leg appendages, each appendage including a connector at one end received in at least one of the openings;

a detent within the torso associated with each opening receiving and retaining in the torso a connector received in the opening, the connector being provided with a plurality of planar surfaces around its circumference and the appendage opening of the torso receiving the connector having at least one planar surface positioned to mate with one of the connector planar surfaces when the connector is biased against the opening planar surfaces by the detent associated with the torso opening receiving the connector;

biasing members mounted on the torso so as to bias each connector received in any of the openings out of the receiving openings; and an actuator in the torso coupled with at least two of the detents so as to simultaneously move the at least two detents and release any connectors being detained by any of the at least two detents.

* * * * *